US009090081B2

(12) United States Patent
Wei et al.

(10) Patent No.: US 9,090,081 B2
(45) Date of Patent: Jul. 28, 2015

(54) INK SUPPLY SYSTEM AND MULTIFUNCTIONAL PRINTER

(71) Applicants: Cal-Comp Electronics & Communications Company Limited, New Taipei (TW); Kinpo Electronics, Inc., New Taipei (TW)

(72) Inventors: Chung-Hsin Wei, New Taipei (TW); Hung-Huan Sung, New Taipei (TW)

(73) Assignees: Cal-Comp Electronics & Communications Company Limited, New Taipei (TW); Kinpo Electronics, Inc., New Taipei (TW)

( * ) Notice: Subject to any disclaimer, the term of this patent is extended or adjusted under 35 U.S.C. 154(b) by 271 days.

(21) Appl. No.: 13/778,069

(22) Filed: Feb. 26, 2013

(65) Prior Publication Data

US 2014/0085386 A1 Mar. 27, 2014

Related U.S. Application Data

(63) Continuation-in-part of application No. 13/747,439, filed on Jan. 22, 2013, now Pat. No. 8,752,942.

(30) Foreign Application Priority Data

Sep. 21, 2012 (TW) ..... 101134810 A
Dec. 20, 2012 (TW) ..... 101148797 A

(51) Int. Cl.
*B41J 29/13* (2006.01)
*B41J 2/175* (2006.01)
*B41J 29/02* (2006.01)

(52) U.S. Cl.
CPC ..... *B41J 2/17596* (2013.01); *B41J 2/175* (2013.01); *B41J 2/1752* (2013.01); *B41J 29/02* (2013.01); *B41J 29/13* (2013.01)

(58) Field of Classification Search
CPC ..... B41J 2/17596; B41J 2/175; B41J 29/13; B41J 29/02; B41J 2/1752
USPC ..... 347/89, 86, 85, 108
See application file for complete search history.

(56) References Cited

U.S. PATENT DOCUMENTS

| | | | | |
|---|---|---|---|---|
| 4,639,738 | A * | 1/1987 | Young et al. | 347/89 |
| 6,779,880 | B1 * | 8/2004 | Kulpa et al. | 347/86 |
| 7,431,439 | B2 * | 10/2008 | Fujioka | 347/86 |
| 7,942,509 | B2 * | 5/2011 | Kobayashi | 347/86 |

(Continued)

FOREIGN PATENT DOCUMENTS

| | | |
|---|---|---|
| TW | 200838713 | 10/2008 |
| TW | I321527 | 10/2008 |
| TW | M355823 | 5/2009 |

OTHER PUBLICATIONS

"Office Action of Taiwan Counterpart Application", issued on Nov. 18, 2014, p. 1-p.8.

*Primary Examiner* — Julian Huffman
*Assistant Examiner* — Carlos A Martinez
(74) *Attorney, Agent, or Firm* — Jianq Chyun IP Office

(57) ABSTRACT

An ink supply system including a cover, an ink delivery module, delivery pipes and a shut-off valve module, and a media recording device including a body and a print head disposed therein are provided. The cover is pivoted to the body, and the ink delivery module is disposed therein and next to the cover. The shut-off valve module includes a base disposed in the body, an eccentric wheel pivoted to the base, and a linkage connected between the eccentric wheel and the cover. The delivery pipes are connected between the print head and the ink delivery module and they pass between the base and the eccentric wheel. The cover is opened or closed relative to the body and it drives the linkage to drive the eccentric wheel to rotate relative to the base so as to press against or release the delivery pipes.

19 Claims, 14 Drawing Sheets

(56) References Cited

U.S. PATENT DOCUMENTS 8,231,209 B2 * 7/2012 Koizumi et al. ..... 347/85
8,752,942 B2 * 6/2014 Wei et al. ..... 347/85
2006/0256172 A1 * 11/2006 Kobayashi ..... 347/86
2012/0050416 A1 3/2012 Ishizawa et al.

* cited by examiner

INK SUPPLY SYSTEM AND MULTIFUNCTIONAL PRINTER

CROSS-REFERENCE TO RELATED APPLICATION

This application is a continuation-in-part application of and claims the priority benefit of U.S. application Ser. No. 13/747,439, filed on Jan. 22, 2013, now pending. The U.S. application Ser. No. 13/747,439 claims the priority benefit of Taiwan application serial no. 101134810, filed on Sep. 21, 2012. This application also claims the priority benefit of Taiwan application serial no. 101148797 filed on Dec. 20, 2012. The entirety of each of the above-mentioned patent applications is hereby incorporated by reference herein and made a part of this specification.

BACKGROUND

1. Technical Field

The invention relates generally to an ink supply system and a media recording device. More particularly, the invention relates to an ink supply system and a media recording device having a shut-off valve module.

2. Related Art

With the advent of the information society, automated equipments such as the scanner, photocopier, or the printer are being installed in the office, and users may perform secretarial processing operations using these automated office equipments. It should be noted that when the various types of automated office equipments above are simultaneously disposed in the office, a lot of space is consumed. As a result, a multi-function peripheral (MFP) integrating functions such as copying, printing, and scanning is developed to solve the above issue.

As an example, after a multi-function peripheral having an inkjet printing function has been used for a period of time, an executed printing operation may need to be paused in order to replace an ink cartridge because the ink in the cartridge has been depleted. Additionally, since the ink cartridge cannot be reused, there is a resource waste issue.

Moreover, another type of currently available ink supply system configures an ink container outside of the inkjet printer. By using the delivery pipes connected to the ink container and the ink cartridges disposed inside the inkjet printer, ink is guided from the ink container into the ink cartridges by utilizing a vacuum ink guiding principle. Although this method can be environmentally friendly, space outside of the inkjet printer is occupied because the ink container is disposed outside of the inkjet printer. Furthermore, when users add ink to the ink cartridges, ink may leak from the print head because of the connection of the delivery pipes.

SUMMARY

The invention provides an ink supply system and a media recording device, in which the ink delivery module is exposed outside when the cover is opened relative to the body, for ease of the user to add ink, and to prevent ink leakage by using the shut-off valve module.

The invention provides an ink supply system adapted for a media recording device. The media recording device includes a body and a print head disposed in the body. The ink supply system includes a cover, an ink delivery module, a plurality of delivery pipes, and a drive module. The cover is pivoted to the body, and the cover is adapted to open relative to the body so as to expose a plurality of elements disposed in the body. The print head is disposed in the body, the ink delivery module is disposed in the body and next to the cover, and the ink delivery module has a plurality of color ink cartridges. The delivery pipes are connected between the print head and the ink delivery module. The drive module includes a first drive element and a second drive element. The first drive element is disposed on the ink delivery module, the second drive element is disposed on at least one of the body and the cover, and the second drive element is linked to the first drive element.

The invention provides a media recording device, including a body, a cover, a print head, an ink delivery module, a plurality of delivery pipes, and a shut-off valve module. The cover is pivoted to the body, and the cover is adapted to open relative to the body so as to expose a plurality of elements disposed in the body. The print head is disposed in the body, the ink delivery module is disposed in the body and next to the cover, and the ink delivery module has a plurality of color ink cartridges. The shut-off valve module includes a base, an eccentric wheel, and a linkage. The base is disposed in the body, the eccentric wheel is pivoted to the base, and the linkage is connected between the eccentric wheel and the cover. The delivery pipes are connected between the print head and the ink delivery module, and the delivery pipes pass between the base and the eccentric wheel. The cover rotates relative to the body and drives the linkage to drive the eccentric wheel to rotate relative to the base, so the eccentric wheel presses against or releases the delivery pipes.

According to an embodiment of the invention, the ink supply system further includes a shut-off valve module disposed between the print head and the ink delivery module. The shut-off valve module includes a base, an eccentric wheel, and a linkage. The base is disposed in the body, and the eccentric wheel is pivoted to the base. The linkage is connected between the eccentric wheel and the cover, and the delivery pipes pass between the base and the eccentric wheel. The cover rotates relative to the body and drives the linkage to drive the eccentric wheel to rotate relative to the base, so the eccentric wheel presses against or releases the delivery pipes.

According to an embodiment of the invention, the first drive element and the second drive element are gear wheels. The first drive element is pivoted to the cover, and the second drive element is disposed on the body. The first drive element rotates along the second drive element so the cover rotates relative to the body.

According to an embodiment of the invention, the second drive element has a guide slot, the cover has a camshaft, and the camshaft is inserted in the guide slot and connected to an end of the linkage, so the cover and the linkage are guided and restricted by the guide slot.

According to an embodiment of the invention, each of the ink cartridges of the ink delivery module has a cartridge body and an ink injection hole located on a side wall of the cartridge body. The cartridge body is disposed on the cover to rotate relative to the body along with the cover, so the ink injection hole faces the print head or is exposed outside of the body.

According to an embodiment of the invention, the first drive element is a gear wheel pivoted to the ink delivery module, and the second drive element is a gear rack. A first section of the gear rack is disposed on the body, a second section of the gear rack is disposed on the cover. When the cover is closed relative to the body, the first section and the second section are separated from each other. When the cover is opened relative to the body, the first section is connected to the second section, and the ink delivery module is slid out of the body by using the first drive element to rotate along the first section and the second section.

According to an embodiment of the invention, the media recording device further includes a first rail and a second rail. The first rail is disposed on a bottom surface of the ink delivery module, and the second rail is correspondingly coupled to the first rail. A third section of the second rail is disposed on the body, and a fourth section of the second rail is disposed on the cover. When the cover is closed relative to the body, the third section and the fourth section are separated from each other. When the cover is opened relative to the body, the third section is connected to the fourth section. Moreover, the ink delivery module is slid out of the body by using the first rail to slide along the third section and the fourth section.

According to an embodiment of the invention, each of the ink cartridges of the ink delivery module has a cartridge body and an ink injection hole located on a top wall of the cartridge body, and the ink injection slides in or slides out of the body along with the cartridge body.

According to an embodiment of the invention, the media recording device further includes a pivot and a plurality of pipes. The pivot is pivoted to the body, and the pipes are inserted on the pivot. The delivery pipes are joined to the corresponding pipes so the delivery pipes and the pipes rotate relative to a wall. Each of the delivery pipes includes a first part and a second part, and the first part and the second part of a same delivery pipe are connected to two opposite ends of a same pipe.

According to an embodiment of the invention, the media recording device further includes a damping element disposed on a side of the ink delivery module not configured with the first drive element, and the damping element is leaned between the body and the cover.

In summary, the ink supply system and the media recording device according to the embodiments of the invention have the shut-off valve module, and by using the linkage connected between the cover and the eccentric wheel in the shut-off valve module to drive the eccentric wheel to press against the delivery tubes when the cover is opened, ink is prevented from flowing to the print head and affecting the printing procedure of the media recording device when the user adds ink to the ink delivery module.

Several exemplary embodiments accompanied with figures are described in detail below to further describe the disclosure in details.

BRIEF DESCRIPTION OF THE DRAWINGS

The accompanying drawings constituting a part of this specification are incorporated herein to provide a further understanding of the disclosure. Here, the drawings illustrate embodiments of the disclosure and, together with the description, serve to explain the principles of the disclosure.

DESCRIPTION OF EMBODIMENTS

Figure 1:
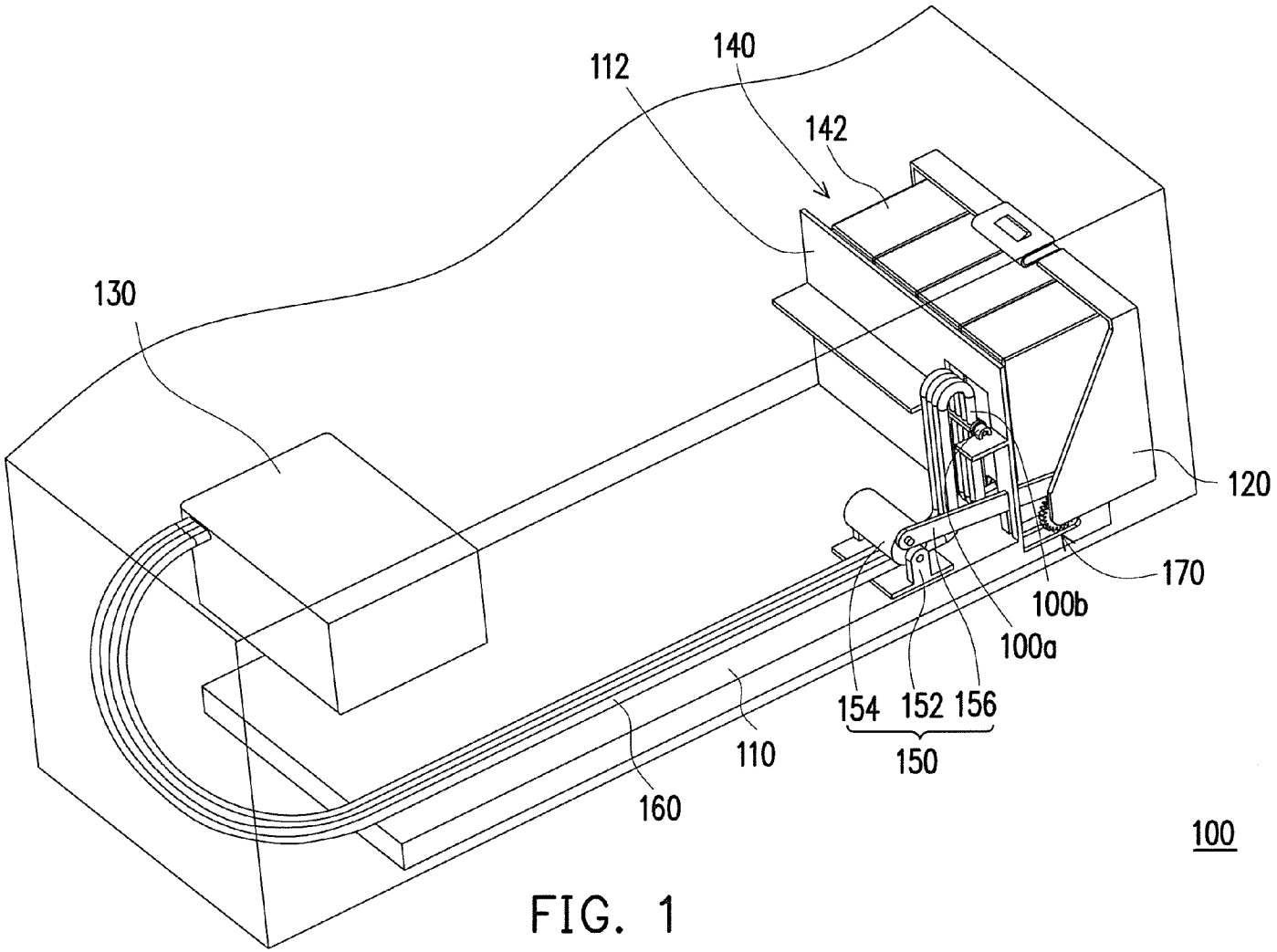
FIG. 1 is a perspective view of a media recording device according to an embodiment of the invention.

FIG. 1 is a perspective view of a media recording device according to an embodiment of the invention. With reference to FIG. 1, a media recording device 100 may be a multi-function peripheral (MFP) having scanning, copying, and printing functions, including a body 110, a cover 120, a print head 130, an ink delivery module 140, a shut-off valve module 150, and a plurality of delivery pipes 160. The cover 120, the ink delivery module 140, the shut-off valve module 150, and the delivery pipes 160 form an ink supply system IS of the media recording device 100. The cover 120 is pivoted to the body, and the cover 120 is adapted to open relative to the body 110 so as to expose a plurality of elements (not drawn) disposed in the body 110. The print head 130 is disposed in the body 110, and the ink delivery module 140 has a plurality of color ink cartridges (not drawn). The ink delivery module 140 is disposed in the body 110 next to the cover 120. The delivery pipes 160 are connected between the print head 130 and the ink delivery module 140, so that the ink in the ink delivery module 140 can flow to the print head 130 through the corresponding delivery pipes 160. The shut-off valve module 150 is disposed in the body 110, and located between the print head 130 and the ink delivery module 140.

Figure 2:
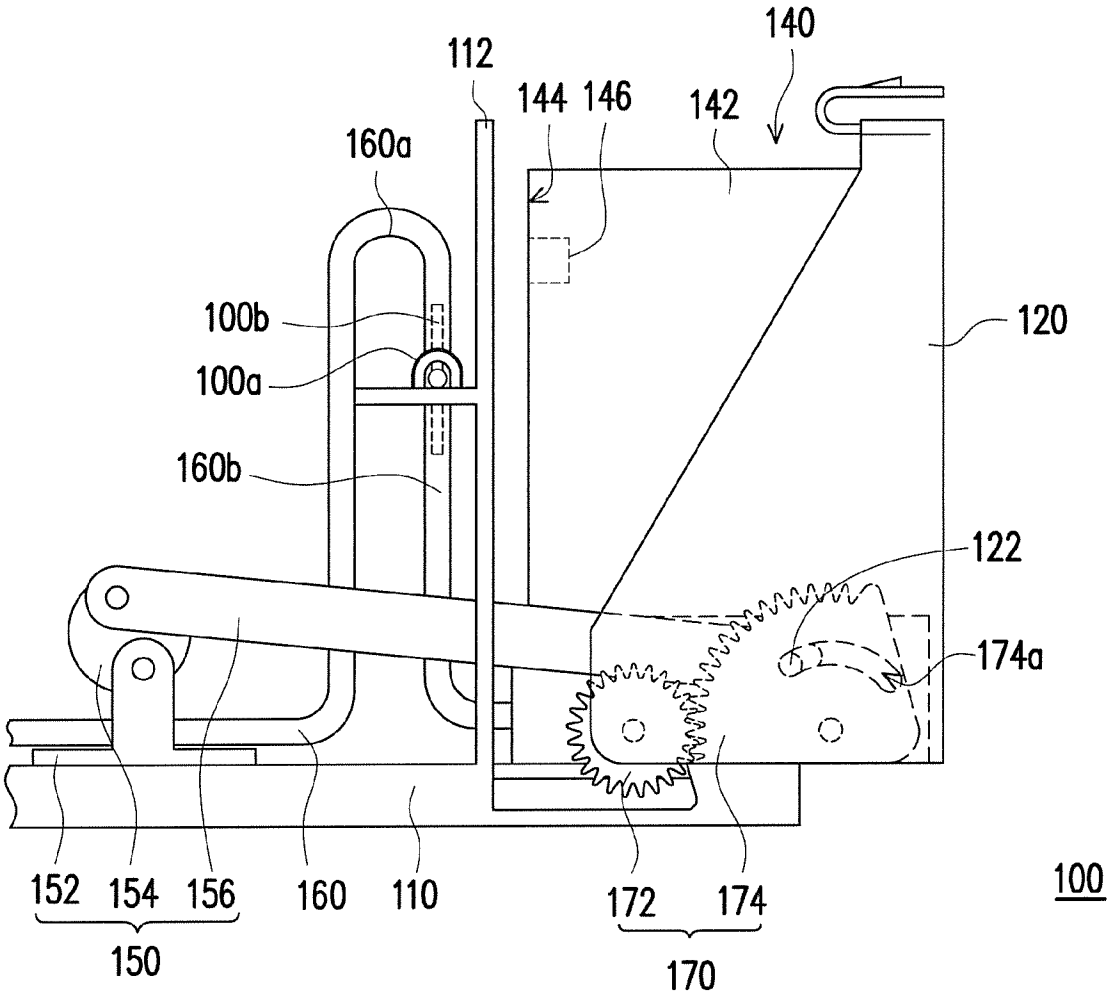
FIG. 2 is a partial side view of the media recording device depicted in FIG. 1.
Figure 3:
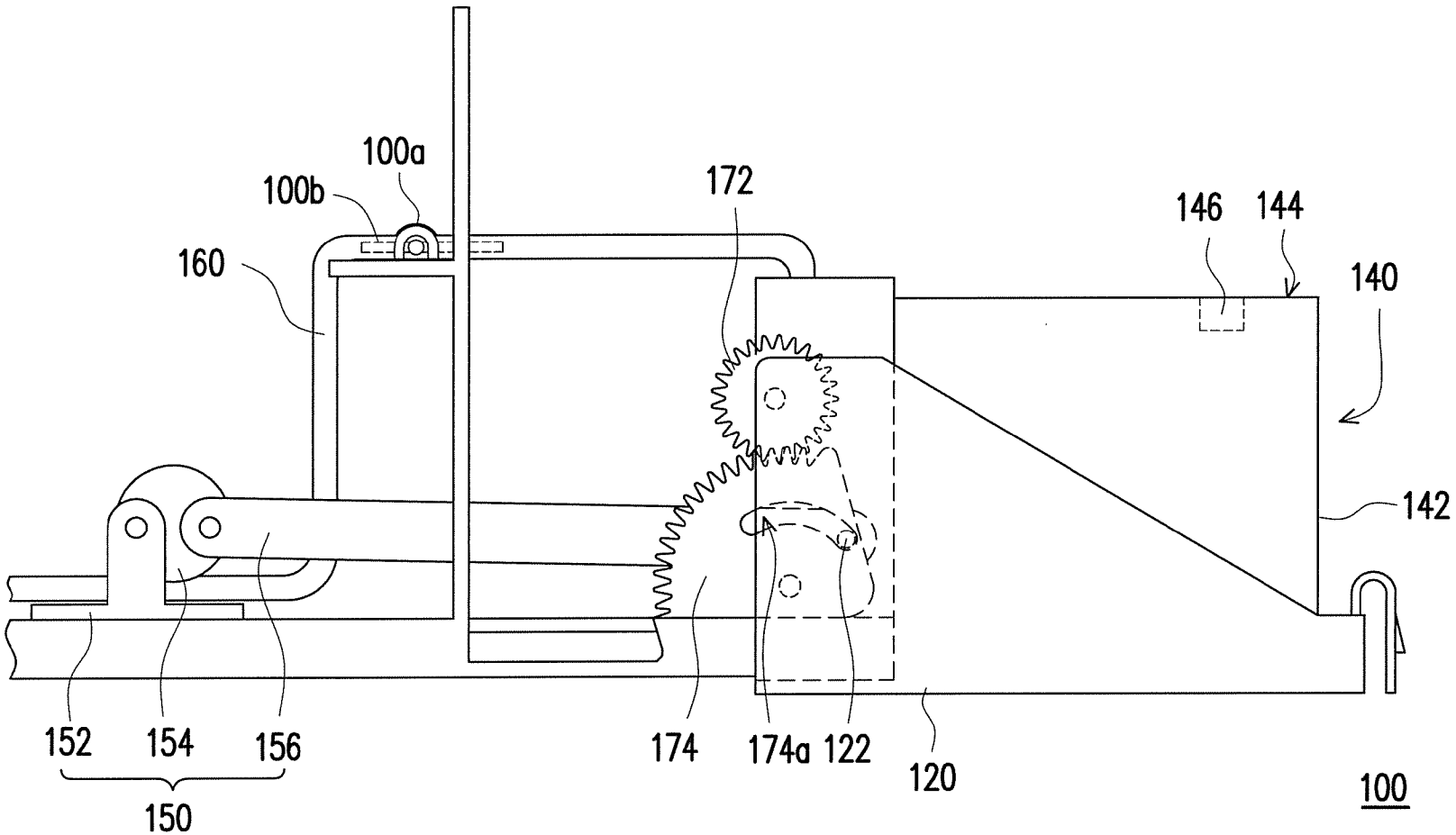
FIG. 3 is a partial side view of the media recording device depicted in FIG. 1 with the cover open relative to the body.

FIG. 2 is a partial side view of the media recording device depicted in FIG. 1. FIG. 3 is a partial side view of the media recording device depicted in FIG. 1 with the cover open relative to the body. With reference to FIGS. 2 and 3, in specifics, the shut-off valve module 150 includes a base 152, an eccentric wheel 154, and a linkage 156. The base 152 is disposed in the body 110, the eccentric wheel 154 is pivoted to the base 152, and the linkage 156 is connected between the eccentric wheel 154 and the cover 120. The delivery pipes 160 pass between the base 152 and the eccentric wheel 154. When the cover 120 is closed relative to the body 119, which is the state of the two relative positions illustrated in FIG. 2, a distance is provided between the eccentric wheel 154 and the base 152 for the delivery tubes 160 to pass, and so the ink can flow in the delivery tubes 160.

When ink needs to be added, the cover 120 can be opened relative to the body 110, such that the state of the two relative positions illustrated in FIG. 3 is when the cover 120 is opened relative to the body 110. The cover 120 drives the linkage 156 to drive the eccentric wheel 154 to rotate relative to the base 152. At this time, the delivery pipes 160 located between the eccentric wheel 154 and the base 152 is pressed, so as to prevent the ink flowing to the print head 130 through the delivery pipes 160 when ink is being added, and affecting the printing procedure of the multi-function peripheral 100. When the relative positions of the cover 120 and the body 110 are returned to the state illustrated in FIG. 2, the linkage 156 drives the eccentric wheel 154 to release the delivery pipes 160. At this time, the ink can again flow in the delivery pipes 160.

With reference to FIGS. 2 and 3, the ink supply system IS further includes a drive module 170 located on a side of the ink delivery module 140. The drive module 170 includes a first drive element 172 and a second drive element 174. The first drive element 172 is pivoted to the cover 120, and the second drive element 174 is disposed on the body 110 and linked to the first drive element 172. Moreover, each of the ink cartridges of the ink delivery module 140 has a cartridge body 142, and the cartridge body 142 has a side wall 144 and an ink injection hole 146 (only one of the cartridge bodies 142 is illustrated in the side views of FIGS. 2 and 3). When the cover 120 is closed relative to the body 110, the ink injection hole 146 is located on the side wall 144 of the cartridge body 142 facing the print head 130 (the print head 130 is shown in FIG. 1).

With reference to FIGS. 2 and 3, in the present embodiment, the first drive element 172 and the second drive element 174 are both gear wheels, and the first drive element 172 is engaged to the second drive element 174. In specifics, the first drive element 172 is a gear wheel pivoted on the cover 120, and the second drive element 174 is a partial gear structure integrally formed with the body 110. Moreover, the second drive unit 174 has a guide slot 174*a*, the cover 120 has a camshaft 122. The camshaft 122 is inserted in the guide slot 174*a* and connected to an end of the linkage 156, so that the cover 120 and the linkage 156 are simultaneously guided and restricted by the guide slot 174*a*.

When the cover 120 is opened relative to the body 110, the ink delivery module 140 exhibits the state illustrated in FIG. 3 with the rotation, and at this time, the injection hole 146 on the side wall 144 is exposed for the user to inject ink. It should be noted that, as the first drive element 172 engages with the second drive element 174, a buffering and stabilizing effect can be provided for the ink delivery module 140 during the rotation. As a result, the ink delivery module 140 gradually falls toward the cover 120, and leaking of the ink inside the cartridge body 142 is prevented. Moreover, due to the guiding and restricting of the guide slot 174*a* of the second drive element 174 and the camshaft 122, the rotation of the ink delivery module 140 relative to the body 110 is stable. It should be noted that, when the cover 120 is opened relative to the body 110, the ink delivery module 140 may not be driven. After the cover 120 is opened, the user can also rotate the ink delivery module 140 to the state shown in FIG. 3 by a manual or an automatic method.

With reference to FIGS. 2 and 3, the ink supply system IS further includes a pivot 100*a* and a plurality of pipes 100*b* (only one of the pipes 100*b* is illustrated in the side views of FIGS. 2 and 3). The pivot 100*a* is pivoted on a wall 112 of the body 110, the pipes 100*b* are inserted on the pivot 100*a*, and each of the delivery pipes 160 is joined to the corresponding pipes 100*b*, such that the delivery pipes 160 and the pipes 100*b* rotate relative to the wall 112. In the present embodiment, the delivery pipes 160 include a first part 160*a* and a second part 160*b*. The first part 160*a* and the second part 160*b* of a same delivery pipe 160 are connected to two opposite ends of a same pipe 100*b*. It should noted that, since one end of the delivery pipes 160 is connected to the ink delivery module 140, when the ink delivery module 140 rotates, the ink delivery module 140 drives the delivery pipes 160, and then the delivery pipes 160 drive the pipes 100*b* to rotate relative to the pivot 100*a*.

Figure 4:
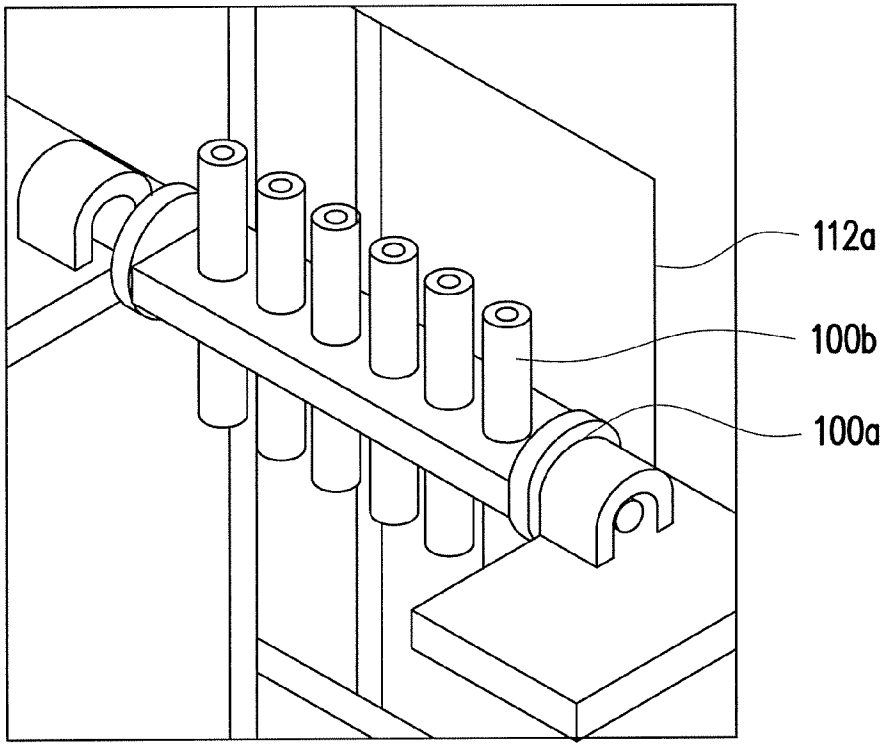
FIG. 4 is a perspective view of the pivot and the pipes not joined to the delivery pipes depicted in FIG. 2.

FIG. 4 is a perspective view of the pivot and the pipes not joined with the delivery pipes depicted in FIG. 2. As shown in FIG. 4, the pipes 100*b* are arranged side by side and inserted on the pivot 100*a*, and each of the pipes 100*b* is hollow. After the delivery pipes 160 are joined to the pipes 100*b*, ink can flow therein. Moreover, as shown in FIG. 4, the wall 112 has an opening 112*a* which can provide a rotating space for the pipes 100*b*.

Figure 5:
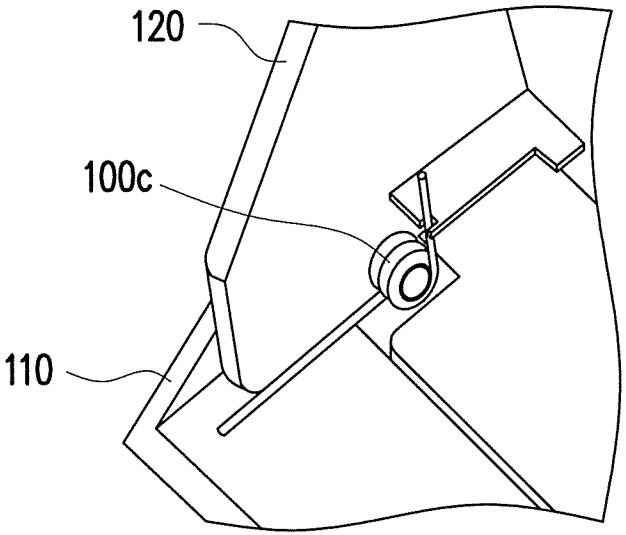
FIG. 5 illustrates the damping element of the media recording device depicted in FIG. 1.

FIG. 5 illustrates the damping element of the media recording device depicted in FIG. 1. In the present embodiment, the media recording device 100 further includes a damping element 100*c*, such as a torsion spring. The damping element 100*c* can provide a buffering effect when the cover 120 is opened or closed. In the present embodiment, the damping element 100*c* is disposed on a side of the ink delivery module 140 not configured with the first drive element 172, and the damping element 100*c* is leaned between the body 110 and the cover 120.

Figure 6:
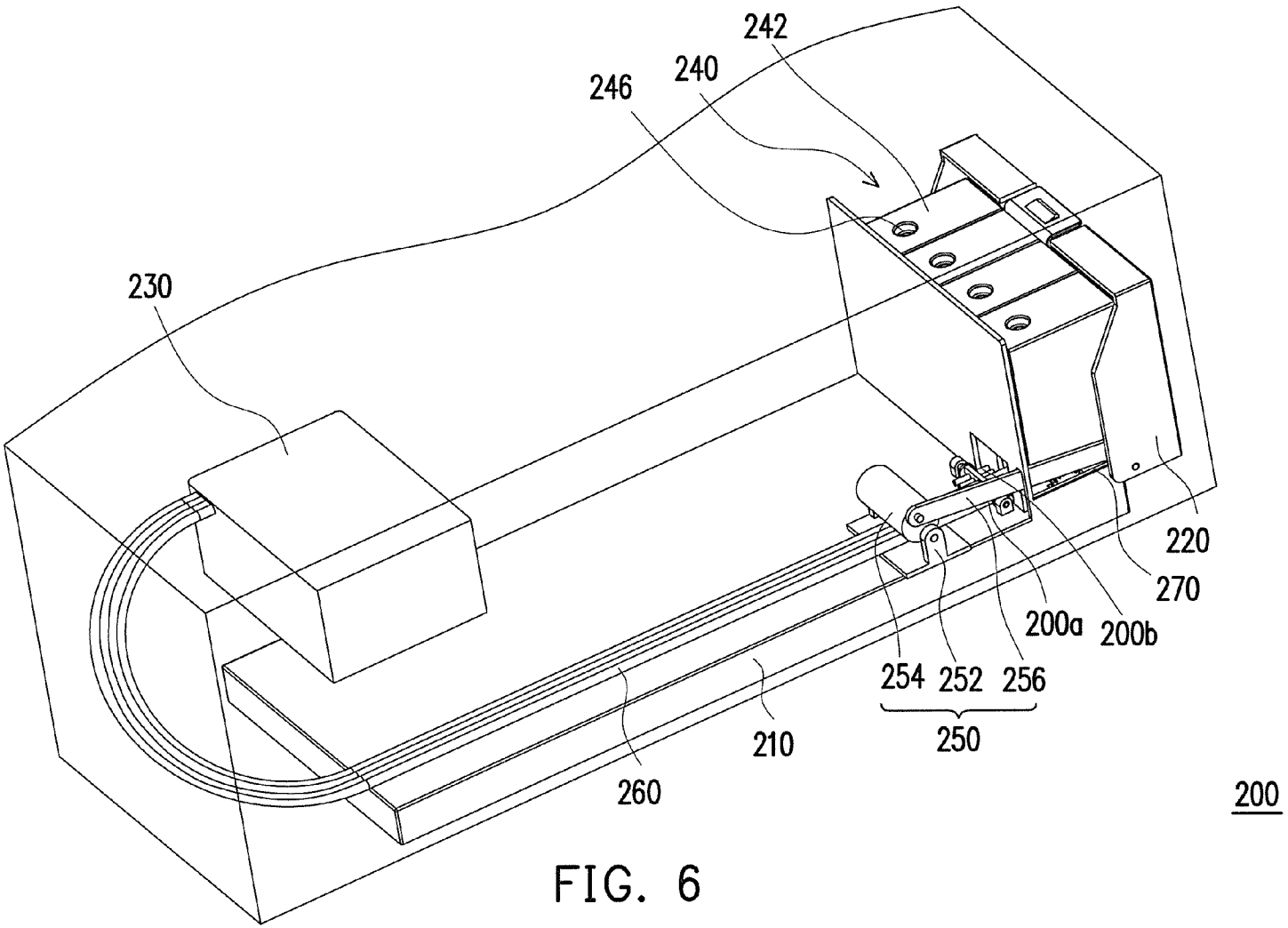
FIG. 6 is a schematic view of a media recording device according to another embodiment of the invention.

FIG. 6 is a schematic view of a media recording device according to another embodiment of the invention. A media recording device 200 includes a body 210, a cover 220, a print head 230, an ink delivery module 240, a shut-off valve module 250, a plurality of delivery pipes 260, and a drive module 270. The cover 220, the ink delivery module 240, the shut-off valve module 250, the delivery pipes 260, and the drive module 270 form an ink supply system IS2. The cover 220 is pivoted to the body 210, and the cover 220 is adapted to open relative to the body 210. The print head 230 is disposed in the body 210, and the ink delivery module 240 is disposed in the body 210 next to the cover 220. The delivery pipes 260 are connected between the print head 230 and the ink delivery module 240. The shut-off valve module 250 is disposed in the body 210, and located between the print head 230 and the ink delivery module 240. The drive module 270 is located on a side of the ink delivery module 240.

The present embodiment is substantially similar to the embodiment illustrated in FIG. 1, with the differences therebetween in the components and operation of the drive module 270, and the movement of the ink delivery module 240 after the cover 220 is opened relative to the body 210. Similar technical contents of the present embodiment and the embodiment illustrated in FIG. 1 are omitted hereafter. For a detailed description of the omitted section, reference can be found in the previous embodiments, and therefore no further elaboration is contained herein.

Figure 7:
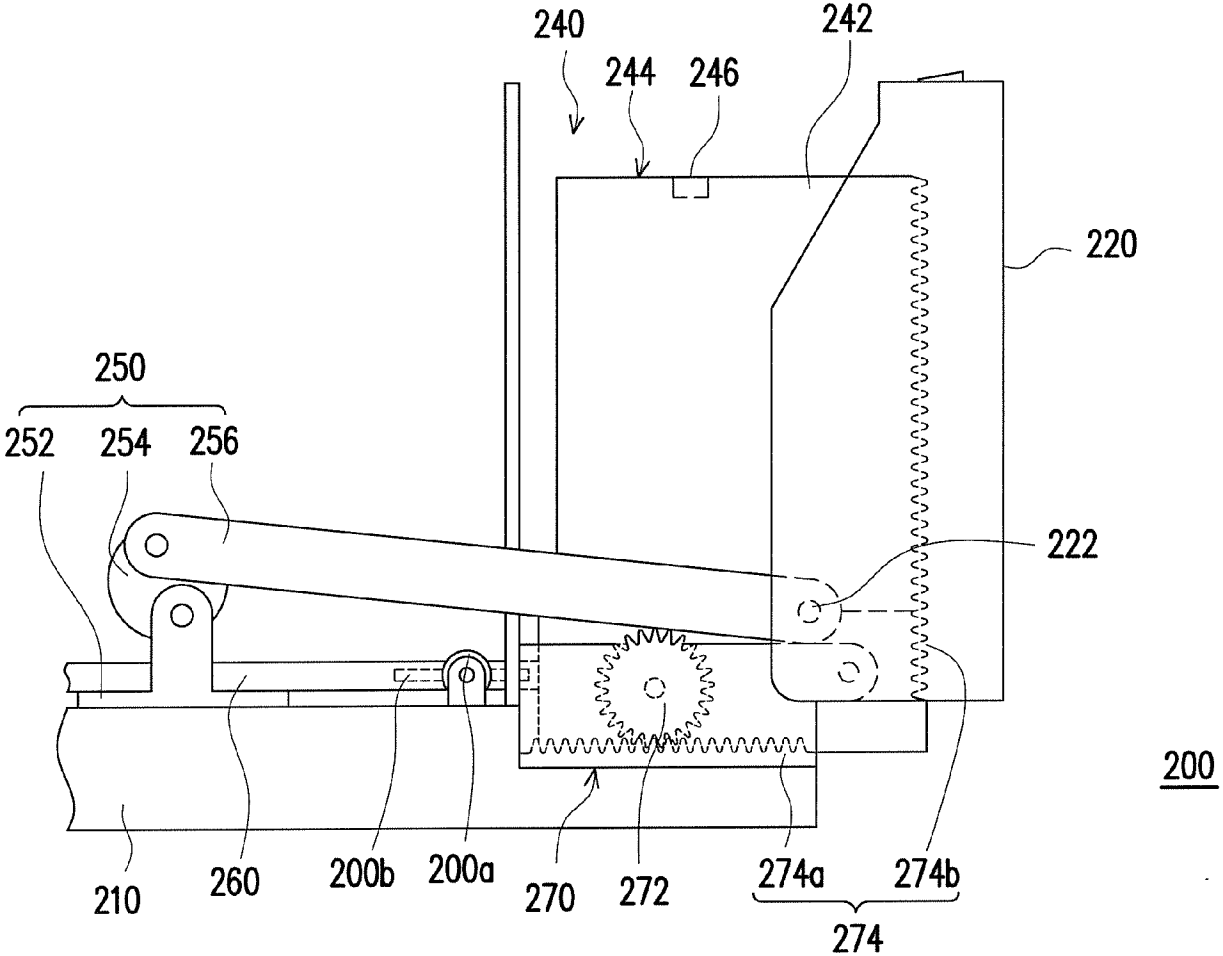
FIG. 7 is a partial side view of the media recording device depicted in FIG. 6.

FIG. 7 is a partial side view of the media recording device depicted in FIG. 6. With reference to FIG. 7, in the shut-off valve module 250, a linkage 256 is connected between an eccentric wheel 254 and the cover 220, and the delivery pipes 260 pass between the base 252 and the eccentric wheel 254. When the cover 220 rotates relative to the body 210 and is opened, the cover 220 drives the linkage 256 to drive the eccentric wheel 254 to rotate relative to the base 252. The delivery pipes 260 located between the eccentric wheel 254 and the base 252 are pressed, so as to prevent the ink from flowing.

As shown in FIG. 7, in the present embodiment, a first drive element 272 is a gear wheel pivoted to the ink delivery module 240, and a second drive element 274 is a gear rack. A first section 274*a* of the second drive element 274 is disposed on the body 210, and a second section 274*b* is disposed on the cover 220. As shown in FIG. 7, when the cover 220 is in a closed state relative to the cover 220, the first section 274*a* and the second section 274*b* are separated from each other. In the present embodiment, each of the ink cartridges of the ink delivery module 240 has a cartridge body 242, and the cartridge body 242 has a top wall 244 and an ink injection hole 246. The ink injection hole 246 is located on the top wall 244. In the present embodiment, the ink supply system IS2 further includes a pivot 200*a* and a plurality of pipes 200*b* having similar functions and appearance as the embodiment illustrated in FIG. 1, although the location of the pivot 200*a* is different from the embodiment of FIG. 1. As shown in FIG. 7, the pivot 200*a* is pivoted to the base of the body 210, and the pipes 200*b* are inserted on the pivot 200*a*.

Figure 8:
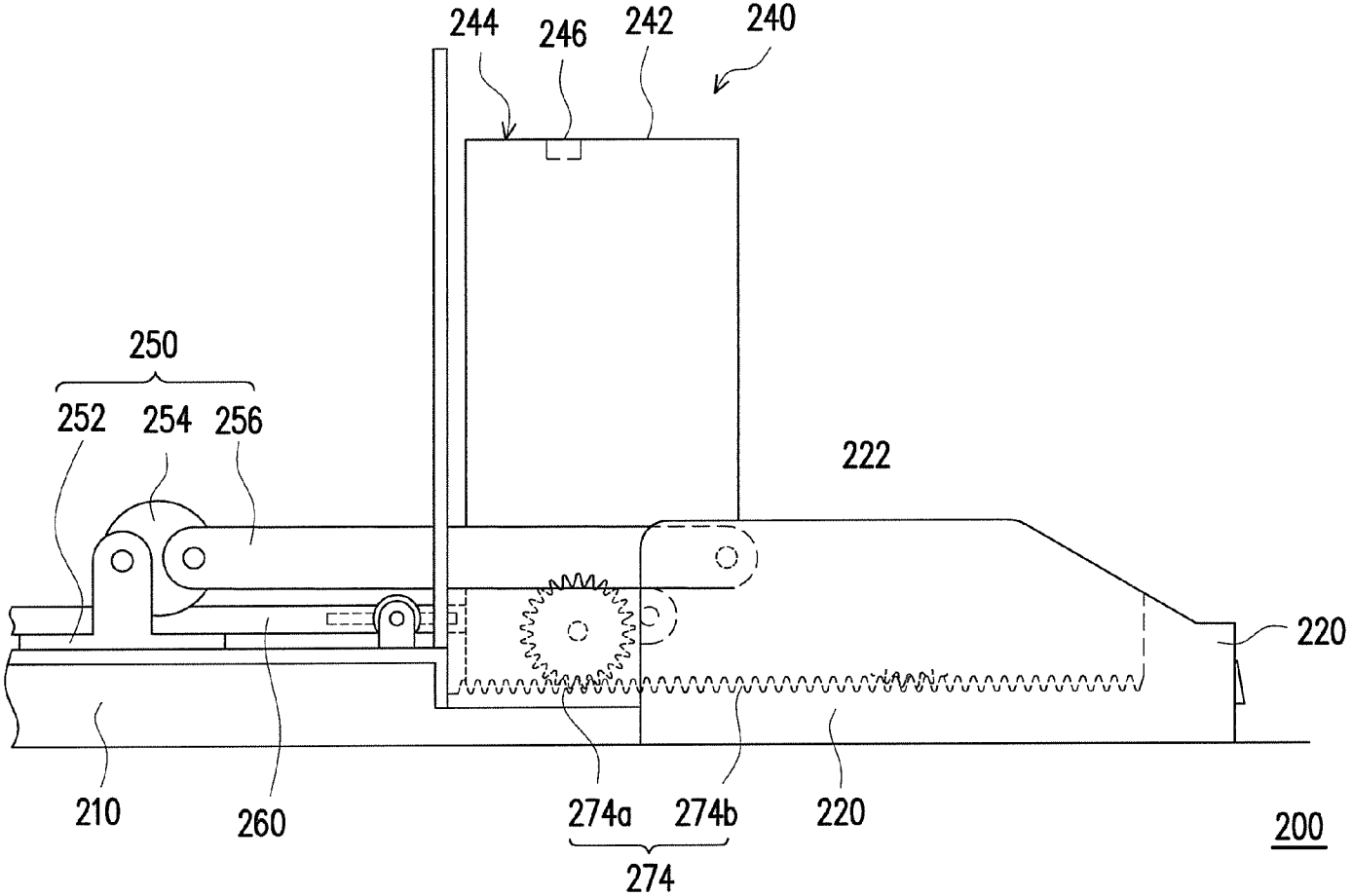
FIG. 8 is a partial side view of the cover depicted in FIG. 6 being opened relative to the body.

FIG. 8 is a partial side view of the cover depicted in FIG. 6 being opened relative to the body. As shown in FIG. 8, when the user realizes that ink needs to be added to the media recording device 200, the cover 220 can be opened relative to the body 210 in preparation for the ink addition. At this time, in the second drive element 274, the first section 274*a* located on the body 210 is connected to the second section 274*b* located on the cover 220 to form an entire connected gear rack. In the present embodiment, the linkage 256 is connected to a camshaft 222 on the cover 220. Therefore, when the cover 220 is opened relative to the body 210, the cover 220 drives the linkage 256 to drive the eccentric wheel 254 to rotate relative to the base 252, so as to press against the delivery pipes 260.

It should be noted that, the ink delivery module 240 in the present embodiment does not rotate along with the cover 220. The user can use the first drive element 272 to slide the ink delivery module 240 out of the body 210 along the connected second drive element 274 by a manual or an automatic method. For the automatic method, the ink supply system IS2 may further include a power source (not drawn) disposed in the body 210, such as a motor or an electromagnetic valve. When the cover 220 is opened relative to the body 210, the power source can drive the ink delivery module 240 to move from inside the body 210 to be on the opened cover 220. Moreover, in the present embodiment, the ink delivery module 240 is shifted from inside the body 210 to outside the body 210. The ink delivery module 240 can be shifted smoothly due to the rotation of the first drive element 272 and the engagement to the second drive element 274. In the present embodiment, ink leaking of the ink delivery module 240 during the moving process is prevented because the ink delivery module 240 does not rotate.

Figure 9:
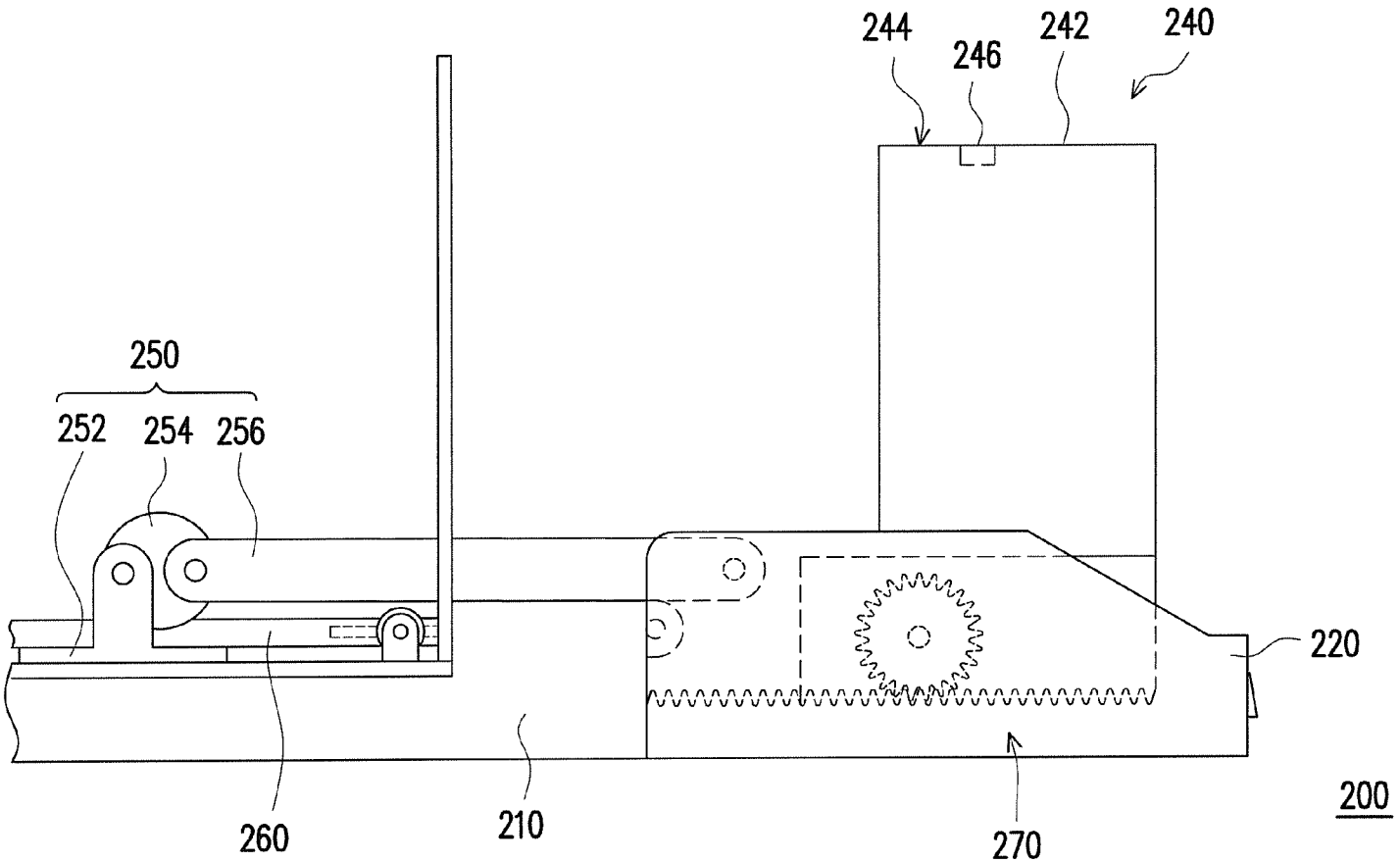
FIG. 9 is a partial side view of the ink delivery module of the media recording device depicted in FIG. 6 moving out of the body.

FIG. 9 is a partial side view of the ink delivery module of the media recording device depicted in FIG. 6 moving out of the body. With reference to FIG. 9, when the ink delivery module 240 is shifted out of the body 210 in the manual or automatic method, the user can add ink through the ink injection hole 246. Similar to the embodiment illustrated in FIG. 1, since the eccentric wheel 254 presses against the delivery pipes 260 at the same time, adding ink does not affect the printing procedure of the print head 230 (not drawn).

Figure 10A:
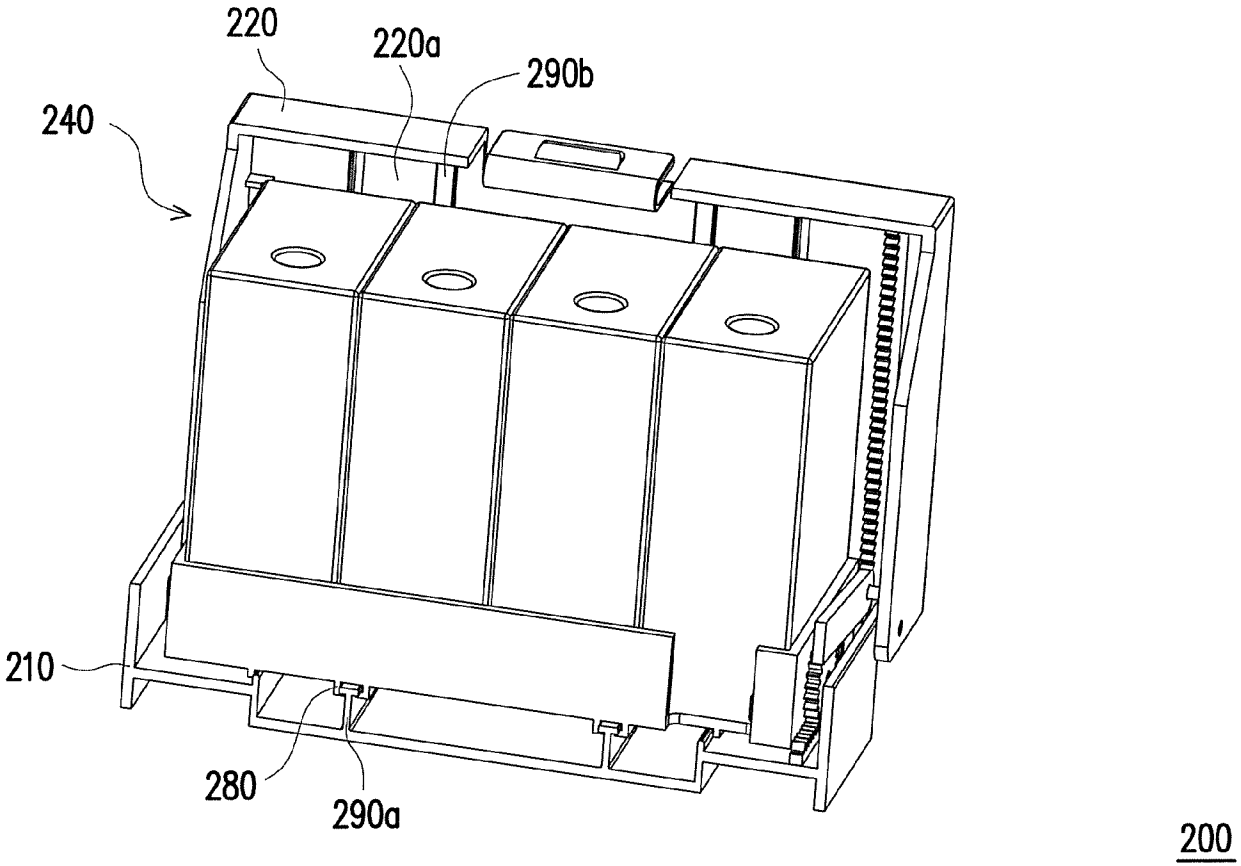
FIG. 10A is a partial perspective view of the media recording device depicted in FIG. 6 from another viewing angle.

FIG. 10A is a partial perspective view of the media recording device depicted in FIG. 6 from another viewing angle. With reference to FIG. 10A, the media recording device 200 further includes a first rail 280 and a second rail 290. The first rail 280 is disposed on a bottom surface of the ink delivery module 240, and the second rail 290 is correspondingly coupled to the first rail 280. The second rail 290 includes a third section 290*a* and a fourth section 290*b*. The third section 290*a* is disposed in the body 210, and the fourth section 290*b* is disposed on a surface 220*a* of the cover 220. Moreover, the surface 220*a* faces the print head 230 when the cover 220 is closed relative to the body 210 (as shown in FIG. 6). As shown in FIG. 10A, when the cover 220 is in the closed state relative to the body 210, the third section 290*a* and the fourth section 290*b* are separated from each other. Moreover, in the present embodiment, the multi-function peripheral 200 includes two first rails 280 and two corresponding second rails 290, although a designer can adjust the quantity of the rails according to practical considerations.

Figure 10B:
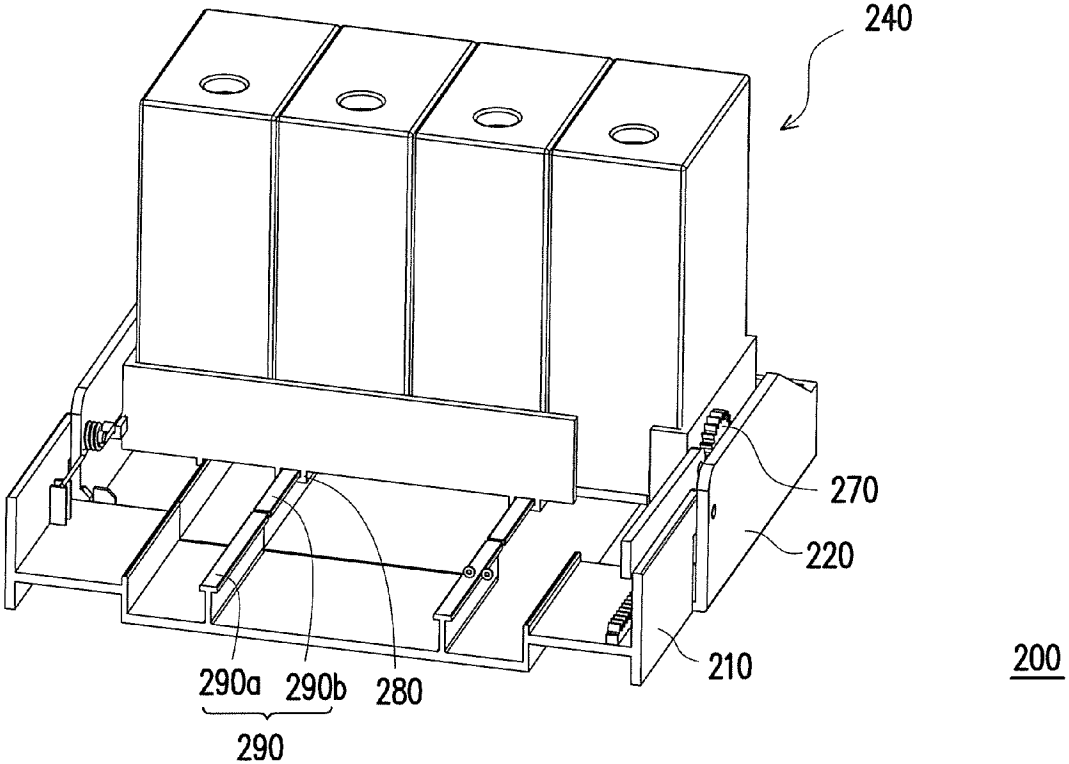
FIG. 10B is a partial perspective view of the cover depicted in FIG. 10A being opened relative to the body.

FIG. 10B is a partial perspective view of the cover depicted in FIG. 10A being opened relative to the body. With reference to FIG. 10B, when the cover 220 is in an open state relative to the body 210, in the second rail 290, the third section 290*a* located in the body 210 is connected to the fourth section 290*b* located on cover 220 to form an entire second rail 290. The user can slide the ink delivery module 240 on the second rail 290 using the first rail 280 with the manual or automatic method, so as to slide the ink delivery module 240 out of the body 210.

In the present embodiment, the first rail 280 is a recessed slide slot, and the second rail 290 is a protruded slide rail. However, in another embodiment which is not illustrated, the first rail is the protruded slide rail, and the second rail is the recessed slide slot. The recessed and protruded designs of the first rail 280 and the second rail 290 can provide preferable sliding restriction of the ink delivery module 240, so as to prevent ink leakage from the ink cartridges when the ink delivery module 240 is sliding. In the present embodiment, the first rail 280 and the second rail 290 coordinate with the drive module 270, so as to provide preferable stability when the ink delivery module 240 is moving.

Figure 11:
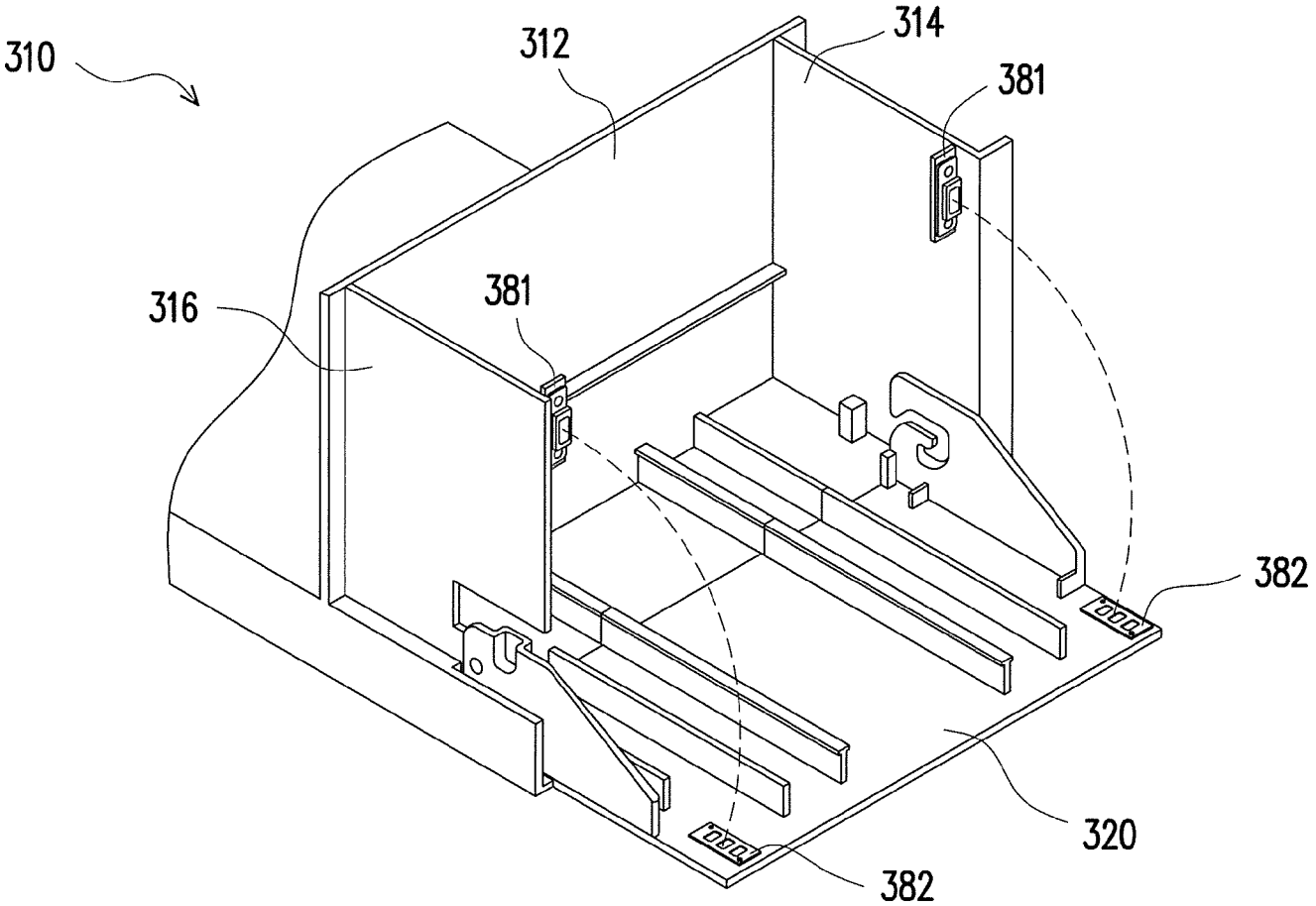
FIG. 11 is a partial schematic view of a media recording device according to another embodiment of the invention.
Figure 12:
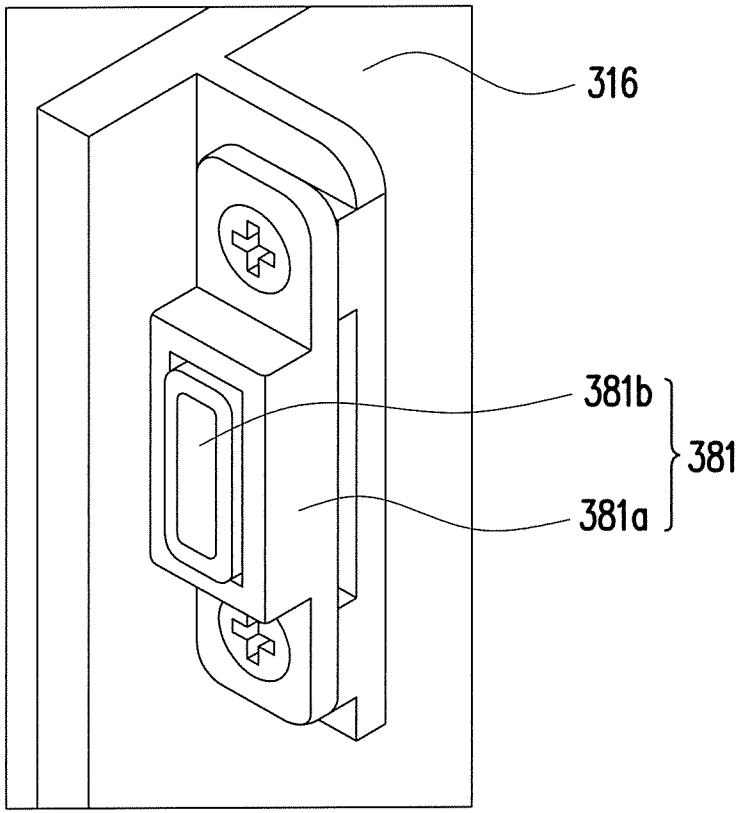
FIG. 12 and FIG. 13 are respective partial enlarged views of FIG. 11.
Figure 13:
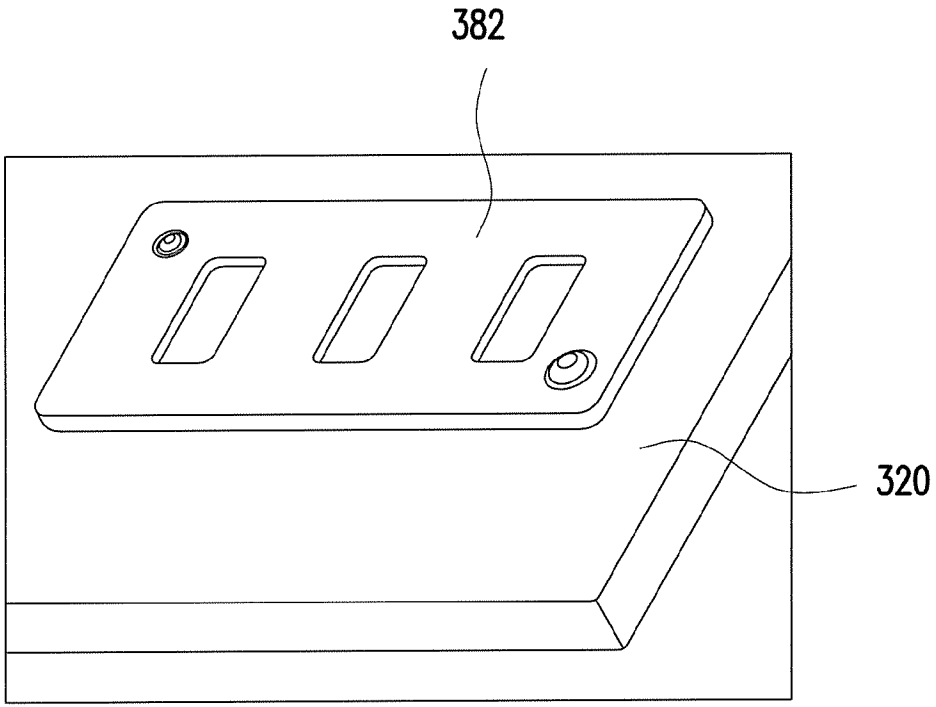

FIG. 11 is a partial schematic view of a media recording device according to another embodiment of the invention. FIG. 12 and FIG. 13 are respective partial enlarged views of FIG. 11. The ink delivery module is omitted for clearer identification of the described components. With reference to FIGS. 11-13, a difference compared to the previous embodiments is that, a body 310 of a media recording device 300 has the walls 312, 314, and 316. The wall 312 is similar to the wall 112 described in the earlier embodiments, and the walls 314 and 316 respectively extend away from the print head (shown in FIG. 1) from two opposite edges of the wall 312. Moreover, the ink supply system IS3 further includes a plurality of first magnetic elements 381 and a plurality of second magnetic elements 382. The first magnetic elements 381 are disposed on the inner surfaces of the walls 314 and 316, and the second magnetic elements 382 are disposed on the cover 320. In the present embodiment, the first magnetic elements 381 are formed by a holder 381*a* screw-locked to the wall 316 (same for the wall 314 on the other side) and a magnetic element 381*b* disposed in the holder 381*a*, although not limited thereto. The first magnetic elements 381 and the second magnetic elements 382 have a magnetic attraction property. Therefore, when the cover 320 is closed on the body 310, the cover 320 is joined with the walls 314 and 316 by the first magnetic elements 381 and the second magnetic elements 382.

In view of the foregoing, in the ink supply system and the media recording device according to the embodiments of the invention, by using the linkage to drive the eccentric wheel in the shut-off valve to press against the delivery tubes when the cover is opened, ink is prevented from flowing to the print head and affecting the printing procedure of the multi-function peripheral when the user adds ink to the ink delivery module. Moreover, the ink supply system may further include the drive module to provide preferable stability when the ink delivery module moves. The drive module includes two different designs, and therefore the media recording device has preferable design flexibility. Accordingly, the media recording device of the embodiments can provide ease of operation for the user.

Although the invention has been described with reference to the above embodiments, it will be apparent to one of the ordinary skill in the art that modifications to the described embodiment may be made without departing from the spirit of the invention. Accordingly, the scope of the invention will be defined by the attached claims not by the above detailed descriptions.

What is claimed is:

1. An ink supply system adapted for a media recording device, the media recording device comprising a body and a print head disposed in the body, the ink supply system comprising:

a cover pivoted to the body, and the cover is adapted to open relative to the body so as to expose a plurality of elements disposed in the body;

an ink delivery module disposed in the body and next to the cover, and the ink delivery module has a plurality of color ink cartridges;

a plurality of delivery pipes connected between the print head and the ink delivery module;

a drive module, comprising:

a first drive element disposed on the ink delivery module;

a second drive element disposed on at least one of the body and the cover, and the second drive element is linked to the first drive element;

a pivot pivoted to the body; and a plurality of pipes inserted on the pivot, the delivery pipes being joined to the corresponding pipes so the delivery pipes and the pipes rotate relative to a wall, wherein each of the delivery pipes comprises a first part and a second part, and the first part and the second part of a same delivery pipe are connected to two opposite ends of a same pipe.

2. The ink supply system of claim 1, further comprising:

a shut-off valve module disposed between the print head and the ink delivery module, the shut-off valve module comprising:

a base disposed in the body;

an eccentric wheel pivoted to the base; and a linkage connected between the eccentric wheel and the cover, the delivery pipes passing between the base and the eccentric wheel, the cover rotating relative to the body and driving the linkage to drive the eccentric wheel to rotate relative to the base, so the eccentric wheel presses against or releases the delivery pipes.

3. The ink supply system of claim 1, wherein the first drive element and the second drive element are gear wheels, the first drive element is pivoted to the cover, the second drive element is disposed on the body, and the first drive element rotates along the second drive element so the cover rotates relative to the body.

4. The ink supply system of claim 3, wherein the second drive element has a guide slot, the cover has a camshaft, and the camshaft is inserted in the guide slot and connected to an end of the linkage, so the cover and the linkage are guided and restricted by the guide slot.

5. The ink supply system of claim 3, wherein each of the ink cartridges of the ink delivery module has a cartridge body and an ink injection hole located on a side wall of the cartridge body, the cartridge body is disposed on the cover to rotate relative to the body along with the cover, so the ink injection hole faces the print head or is exposed outside of the body.

6. The ink supply system of claim 1, wherein the first drive element is a gear wheel pivoted to the ink delivery module, the second drive element is a gear rack, a first section of the gear rack is disposed on the body, a second section of the gear rack is disposed on the cover, and when the cover is closed relative to the body, the first section and the second section are separated from each other, and when the cover is opened relative to the body, the first section is connected to the second section, and the ink delivery module is slid out of the body by using the first drive element to rotate along the first section and the second section.

7. The ink supply system of claim 6, further comprising:

a first rail disposed on a bottom surface of the ink delivery module; and a second rail correspondingly coupled to the first rail, a third section of the second rail being disposed on the body, a fourth section of the second rail being disposed on the cover, and when the cover is closed relative to the body, the third section and the fourth section are separated from each other, and when the cover is opened relative to the body, the third section is connected to the fourth section, and the ink delivery module is slid out of the body by using the first rail to slide along the third section and the fourth section.

8. The ink supply system of claim 6, wherein each of the ink cartridges of the ink delivery module has a cartridge body and an ink injection hole located on a top wall of the cartridge body, and the ink injection hole slides in or slides out of the body along with the cartridge body.

9. The ink supply system of claim 1, further comprising a damping element disposed on a side of the ink delivery module not configured with the first drive element, and the damping element is leaned between the body and the cover.

10. A media recording device, comprising:

a body;

a cover pivoted to the body, and the cover is adapted to open relative to the body so as to expose a plurality of elements disposed in the body;

a print head disposed in the body;

an ink delivery module disposed in the body and next to the cover, and the ink delivery module has a plurality of color ink cartridges;

a shut-off valve module disposed between the print head and the ink delivery module, the shut-off valve module comprising:

a base disposed in the body;

an eccentric wheel pivoted to the base; and a linkage connected between the eccentric wheel and the cover; and a plurality of delivery pipes connected between the print head and the ink delivery module, the delivery pipes passing between the base and the eccentric wheel, wherein the cover is opened or closed relative to the body and drives the linkage to drive the eccentric wheel to rotate relative to the base, so the eccentric wheel presses against or releases the delivery pipes.

11. The media recording device of claim 10, further comprising:

a drive module, comprising:

a first drive element disposed on the ink delivery module; and a second drive element disposed on at least one of the body and the cover, and the second drive element is linked to the first drive element.

12. The media recording device of claim 11, wherein the first drive element and the second drive element are gear wheels, the first drive element is pivoted to the cover, and the second drive element is disposed on the body, the first drive element rotating along the second drive element so the cover rotates relative to the body.

13. The media recording device of claim 12, wherein the second drive element has a guide slot, the cover has a camshaft, and the camshaft is inserted in the guide slot and connected to an end of the linkage, so the cover and the linkage are guided and restricted by the guide slot.

14. The media recording device of claim 12, wherein each of the ink cartridges of the ink delivery module has a cartridge body and an ink injection hole located on a side wall of the cartridge body, the cartridge body is disposed on the cover to rotate relative to the body along with the cover, so the ink injection hole faces the print head or is exposed outside of the body.

15. The media recording device of claim 11, wherein the first drive element is a gear wheel pivoted to the ink delivery module, the second drive element is a gear rack, a first section of the gear rack is disposed on the body, a second section of the gear rack is disposed on the cover, and when the cover is closed relative to the body, the first section and the second section are separated from each other, and when the cover is opened relative to the body, the first section is connected to the second section, and the ink delivery module is slid out of the body by using the first drive element to rotate along the first section and the second section.

16. The media recording device of claim 15, further comprising:

a first rail disposed on a bottom surface of the ink delivery module; and a second rail correspondingly coupled to the first rail, a third section of the second rail being disposed on the body, a fourth section of the second rail being disposed on the cover, and when the cover is closed relative to the body, the third section and the fourth section are separated from each other, and when the cover is opened relative to the body, the third section is connected to the fourth section, and the ink delivery module is slid out of the body by using the first rail to slide along the third section and the fourth section.

17. The media recording device of claim 16, wherein each of the ink cartridges of the ink delivery module has a cartridge body and an ink injection hole located on a top wall of the cartridge body, and the ink injection hole slides in or slides out of the body along with the cartridge body.

18. The media recording device of claim 10, further comprising:

a pivot pivoted to the body; and a plurality of pipes inserted on the pivot, the delivery pipes being joined to the corresponding pipes so the delivery pipes and the pipes rotate relative to a wall, wherein each of the delivery pipes comprises a first part and a second part, and the first part and the second part of a same delivery pipe are connected to two opposite ends of a same pipe.

19. The media recording device of claim 10, further comprising a damping element disposed on a side of the ink delivery module not configured with the first drive element, and the damping element is leaned between the body and the cover.

* * * * *